US008707976B2

(12) United States Patent
Bauer

(10) Patent No.: US 8,707,976 B2
(45) Date of Patent: Apr. 29, 2014

(54) PORTABLE PAINTING APPARATUS

(76) Inventor: Daryl Bauer, Manteca, CA (US)

( * ) Notice: Subject to any disclaimer, the term of this patent is extended or adjusted under 35 U.S.C. 154(b) by 285 days.

(21) Appl. No.: 12/842,913

(22) Filed: Jul. 23, 2010

(65) Prior Publication Data

US 2010/0282283 A1 Nov. 11, 2010

Related U.S. Application Data

(63) Continuation-in-part of application No. 12/574,505, filed on Oct. 6, 2009, now abandoned, which is a continuation of application No. 11/606,615, filed on Nov. 29, 2006, now Pat. No. 7,597,111.

(51) Int. Cl.
*E04H 15/02* (2006.01)

(52) U.S. Cl.
USPC ..... 135/96; 135/95; 135/147; 135/152; 135/120.1; 118/500; 269/905

(58) Field of Classification Search
USPC ..... 135/95–96, 135, 147, 115, 117, 905, 135/152, 120.1; 427/458; 118/500–502; 211/163–165, 113, 117, 204, 206, 952, 211/41.15–41.16; 269/46, 287–288, 296, 269/306, 905; 248/220.21, 339
See application file for complete search history.

(56) References Cited

U.S. PATENT DOCUMENTS

| | | | | | |
|---|---|---|---|---|---|
| RE16,037 | E * | 3/1925 | Berg | 135/98 |
| 1,820,002 | A * | 8/1931 | Forrester | 135/140 |
| 2,729,844 | A * | 1/1956 | Weiss | 15/308 |
| 4,029,117 | A * | 6/1977 | Rain | 135/100 |
| 4,129,217 | A * | 12/1978 | Campbell | 211/95 |
| 6,090,204 | A * | 7/2000 | Speed et al. | 118/500 |
| 6,178,978 | B1 * | 1/2001 | Rieber | 135/96 |
| 6,338,758 | B1 * | 1/2002 | Curran | 118/500 |
| 6,742,309 | B2 * | 6/2004 | Stewart et al. | 52/79.5 |
| 6,875,277 | B1 * | 4/2005 | Edgerton | 118/500 |
| 6,929,478 | B1 * | 8/2005 | Spencer et al. | 434/247 |
| 7,121,418 | B2 * | 10/2006 | Stier | 211/206 |
| 2003/0179576 | A1 * | 9/2003 | Huang | 362/253 |

* cited by examiner

*Primary Examiner* — Winnie Yip
(74) *Attorney, Agent, or Firm* — GSS Law Group

(57) ABSTRACT

A portable painting apparatus comprises a combination of a portable paint booth for holding an object to be painted, removable handles for moving objects coated with wet paint, an optional drying rack for wet painted objects, and accessory hangers adapted for suspending objects inside the portable paint booth or from the drying rack. The portable paint booth includes a support frame with a rotatable hub assembly for painting all sides of an object and a replaceable tent for providing a paint overspray and splatter barrier. The tent may optionally include exhaust ports for withdrawing paint vapor and airborne paint droplets from within the tent. The support frame, removable handles, and drying rack are adapted to hold painted objects coated with wet paint on all sides and edges without damaging the coating of wet paint.

18 Claims, 13 Drawing Sheets

PORTABLE PAINTING APPARATUS

CROSS REFERENCE TO RELATED APPLICATIONS

This application is a continuation in part of U.S. patent application Ser. No. 12/574,505 filed Oct. 6, 2009 now abandoned and titled "Portable Painting Tent", which is a continuation application of U.S. patent application Ser. No. 11/606,615 filed Nov. 29, 2006, titled "Portable Painting Tent" and issued on Oct. 6, 2009 as U.S. Pat. No. 7,597,111.

FIELD OF THE INVENTION

Embodiments of the invention are related to painting tools, and in particular to portable apparatus for holding objects coated with wet paint.

BACKGROUND

Spray painting may be used for painting objects with large or intricately-shaped surfaces such as building doors, window shutters, and so on. Painting may be performed inside a building to prevent wind from causing uneven paint application and to shelter wet paint from debris, dust, and insects. Ordinarily, some of the paint released from equipment such as compressed air sprayers, airless sprayers, or aerosol cans misses an object being painted. Masking materials such as tarps, tape, masking paper, rags, scrap packaging, or building materials may be used to prevent paint overspray from falling on room surfaces and other items near an object being painted. It can be time consuming to find masking materials and construct an overspray barrier at each new job site, especially for painting large objects such as building doors.

Experienced painters generally prefer to paint an object with a single, continuous application of wet paint. When many objects are to be painted, it may be desirable to move a wet painted object away from a work area so another object may be painted. Moving an object as large as a building door without disturbing a coating of wet paint or disarranging overspray barrier materials can be difficult, especially for a person working alone. Furthermore, leaning a painted object against a wall, saw horse, workbench, or other support during painting or drying may leave undesirable marks in a coating of wet paint. Waiting for paint to dry before moving painted objects may delay completion of a painting project.

What is needed is a portable painting apparatus for efficiently painting all sides and edges of an object without waiting for paint to dry. What is also need is a portable painting apparatus having a paint overspray barrier, support means for different objects to be painted, and a drying rack capable of supporting large wet painted objects such as building doors. What is further needed is a portable painting apparatus for moving a freshly painted building door without damaging a coat of wet paint on the door.

SUMMARY

A portable painting apparatus comprises a combination of a portable paint booth for holding an object to be painted, removable handles for moving objects coated with wet paint, an optional drying rack for wet painted objects, and accessory hangers adapted for suspending objects inside the portable paint booth or from the drying rack. The portable paint booth includes a support frame and a tent removably attached to the support frame for providing an overspray barrier and for protecting a coat of wet paint from airborne debris. The tent may optionally include exhaust ports for withdrawing paint vapor and droplets from within the tent.

A support frame for a portable paint booth includes a hub assembly with a hanging bracket, at least three leg assemblies connected to the hub assembly by upper frame members and corner connectors, and leg braces between adjacent leg assemblies. A leg assembly may alternatively comprise telescoping segments, detachable segments joinable end-to-end, or segments joined by hinges into a foldable assembly. The optional drying rack removably attaches to the support frame to provide a convenient and stable drying location for wet painted objects. A drying rack may optionally be expanded by attachment of another drying rack. At least two drawing racks may optionally be joined together to stand independently of a portable paint booth.

Embodiments of the invention include at least one accessory hanger adapted to fit into the hanging bracket in the hub assembly on the support frame or a similar hanging bracket on the drying rack. Some embodiments of an accessory hanger are adapted for attachment to a building door. Other embodiments of an accessory hanger include hooks or spring clips for suspending small or irregularly-shaped objects during painting or drying.

An embodiment of the invention optionally includes at least two removable handles for lifting and carrying a building door without disturbing a coating of wet paint on the door. An example of a handle suitable for use with an embodiment of the invention is described in U.S. Pat. No. 7,597,111 to Bauer, incorporated herein by reference in its entirety. Another example of a handle suitable for use with an embodiment of the invention is described in U.S. patent application Ser. No. 11/605,816 to Bauer, titled "Door Painting Handles", incorporated herein by reference in its entirety. Alternatively, a handle may include a hand grip which is detachable from a receiver having a lockset plug for slidable engagement with a lockset hole in a door, and optionally having pointed posts for slidable engagement with threaded holes in the latch area of a door. Other embodiments of a receiver have pointed posts for slidable engagement with holes in the hinge area of a door.

The above summary is not intended to represent each disclosed embodiment, or every aspect, of the present invention. Other aspects and example embodiments are provided in the Figures and the detailed description that follow.

BRIEF DESCRIPTION OF THE DRAWINGS

Embodiments of the invention may be more completely understood in connection with the accompanying drawings, in which.

DESCRIPTION

Embodiments of the invention comprise a portable painting apparatus with a support frame for suspending an object to be painted, a tent for providing a barrier for paint overspray, drips, and splatter, an optional drying rack which may alternately be attached to the support frame or combined with another drying rack into a free-standing assembly, at least one accessory hanger for suspending an object to be painted from the support frame or drying rack, and at least two removable handles for lifting and carrying a wet painted object such as a building door. A combination of the support frame and the optional tent comprises a portable paint booth for providing effective overspray protection when spray painting indoors. The portable paint booth may also be used outdoors to provide shelter from the wind during spray painting and while wet paint dries. The support frame and optional drying rack are adapted to support painted objects coated with wet paint on all sides and edges without damaging the coating of wet paint.

The portable painting apparatus is well suited for use by a person working alone to paint relatively large objects such as building doors. The portable paint booth may easily be assembled and disassembled without tools and may be separated into parts that are light enough to be carried easily by one person. The optional drying rack may be expanded to support many building doors or other wet painted objects while wet paint dries. A combination of the portable paint booth, accessory hanger, and lifting handles enables a relatively large object such as a building door to be painted efficiently and quickly with one continuous coating of wet paint and moved by one person without disturbing the coating of wet paint. A combination of the portable paint booth, lifting handles, accessory hanger, and drying rack enables objects to be painted, rotated within the portable paint booth to paint all sides of the object, removed from the paint booth, and suspended from a stable, convenient support for drying without damaging a wet coat of paint.

Figure 1:
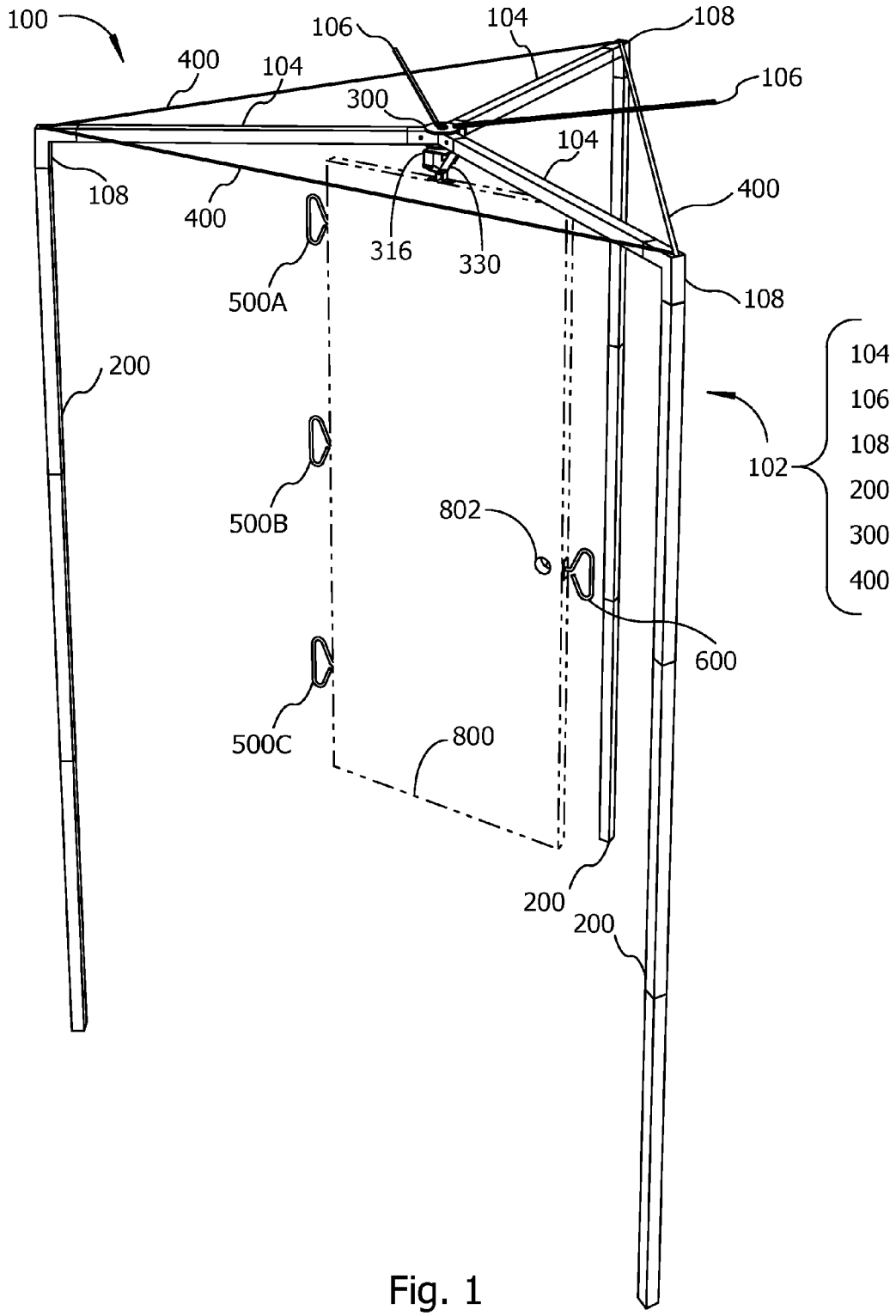
FIG. 1 is pictorial view toward the front and top of an embodiment of the invention including a support frame and door carrying handles, showing the door carrying handles attached to an example of a work piece comprising a door drawn with phantom lines, and further showing the door suspended with a door hanger from a hub assembly on the support frame.

FIG. 1 illustrates a pictorial view of a support frame 102 included with a portable painting apparatus 100. In FIG. 1, a door 800 is suspended from the support frame 102, three hinge handles 500 are attached to the door 800 at three hinge locations A, B, and C, and a latch handle 600 is inserted in a latch hole on the side of the door 800 near a doorknob hole 802. Generally, only one of the hinge handles 500 (500A, 500B, 500C) would be used in cooperation with the latch handle 600 to lift a wet painted door 800, although any one or more of the hinge handles may be used at one's discretion. The door 800, drawn in phantom outline, is representative of an object to be painted. Almost any object up to approximately the size and weight of a building door could be spray painted using an embodiment of the invention. Other examples of objects that could be painted using a portable painting apparatus 100 include, but are not limited to, cabinets, furniture, garage door panels, window shutters, shelves, and miscellaneous small items such as door hardware, lockset hardware, and so on.

The support frame 102 shown in FIG. 1 includes three leg assemblies 200. Alternative embodiments of a support frame 102 include more than three leg assemblies 200, for example to support an especially heavy door or other heavy object, or to provide a larger space for painting than is available with the example of FIG. 1. Each leg assembly is removably connected to a corner connector 108 and comprises one or more leg segments. A leg brace 400 connects each adjacent pair of leg assemblies 200 to improve stability of the portable painting apparatus 100. An upper frame member 104 connects a hub assembly 300 to each corner connector 108 and leg assembly 200. The hub assembly 300 includes a hanging bracket 316, from which the door 800 is suspended by a door hanger 330 removably attached to a side of the door 800. At least two tent support arms 106 removably attached to the hub assembly 300 are provided to hold a tent attached to the support frame 102 away from an object being painted. A tent support arm 106 may optionally be arranged to rest on a leg brace 400 to provide support for a tent.

Summarizing FIG. 1, the illustrated example of a support frame 102 includes three leg assemblies 200, a hub assembly 300, three leg braces 400, three upper frame members 104, two tent support arms 106, and three corner connectors 108. The example of a portable painting apparatus 100 in FIG. 1 includes the support frame 102, an accessory hanger represented by a door hanger 330, and at least two removable handles. In a preferred embodiment, at least one removable handle is a hinge handle 500 and another removable handle is a latch handle 600. The portable painting apparatus may optionally include a tent as will be explained in relation to FIG. 16 and FIG. 33.

Figure 2:
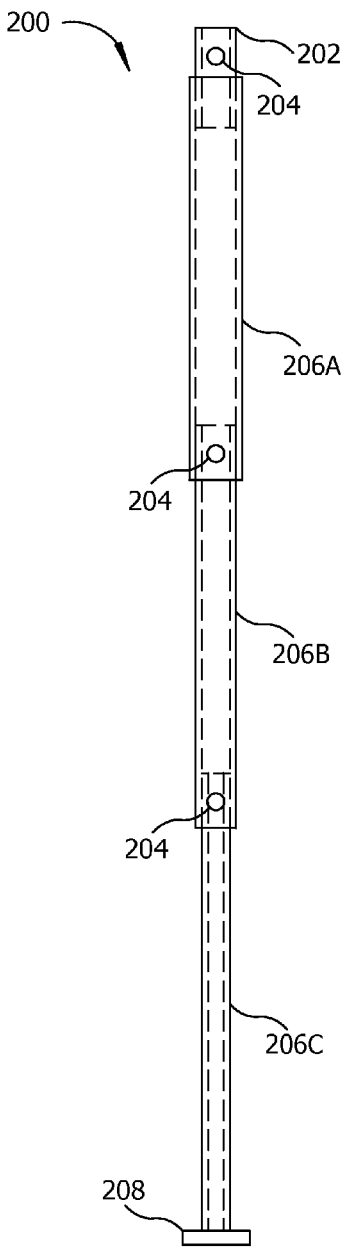
FIG. 2 is a side view of an example of a leg assembly comprising telescoping leg segments.

A leg assembly for a support frame may be disassembled into smaller leg segments for ease of transport and storage. A leg assembly 200 may comprise a selected number of leg segments which fit together into a telescoping structure, as shown in the example of FIG. 2. In FIG. 2, each of three telescoping leg segments 206A, 206B, and 206C has a size and cross sectional shape for slidably attaching to an adjacent leg segment. Locking pin apertures 204 in each leg segment align when the leg assembly 200 is fully extended. A locking pin inserted through the locking pin apertures 204 holds the leg in its extended position. Threaded fasteners may alternatively be used to hold leg segments together. The telescoping leg assembly in FIG. 2 also includes a connector insert 202 for connecting the leg assembly to a corner connector in a support frame, for example the corner connector 108 shown in FIG. 1. A telescoping leg assembly may alternatively be made with twist locks or lever clamps for locking leg segments into a leg assembly having a selected overall length. A foot 208 may optionally be included with a leg assembly 200 as an integral part of a leg segment or as a separate removable part.

Figure 3:
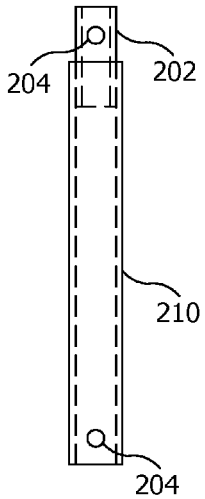
FIG. 3 is a side view of an example of a leg segment for use in a leg assembly having separable leg segments, for example the leg assembly of FIG. 4.

An example of a single leg segment is shown in the side view of FIG. 3. The example of a leg segment 210 includes a connector insert 202 for slidably coupling the leg segment 210 to another leg segment or to a corner connector in a support frame. The connector insert 202 is formed with a locking pin aperture 204 that passes all the way through both sides of the connector insert and aligns with corresponding locking pin apertures 204 near an end of an adjacent leg segment. The connector insert 202 may alternately be made as a separate piece that is attached to the leg segment 210, for example by welding, crimping, or with a strong adhesive, or the connector insert may be formed as an integral part of a leg segment 210, for example by swaging a selected length of the leg segment.

Figure 4:
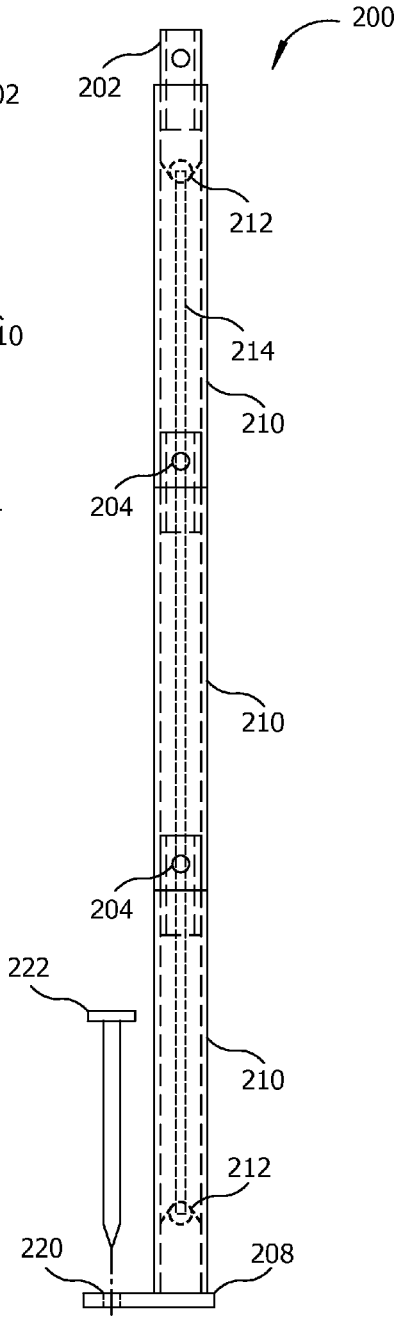
FIG. 4 is a side view of an example of a leg assembly comprising a plurality of separable leg segments joined end to end.

FIG. 4 shows an example of three leg segments 210 joined end to end into a leg assembly 200, with a connector insert 202 on each leg segment fitting into an aperture on an end of an adjacent leg segment. A leg assembly 300 may optionally include a different number of leg segments, and individual leg segments having different lengths may optionally be provided. A selected number of leg segments may be joined together into a leg assembly to make a support frame having a desired height. Locking pin apertures 204 on each connector insert and leg segment are shown in alignment and ready to receive a locking pin to hold the leg segments together. An optional foot 208 is connected to the bottom leg segment 210. A foot 208 may optionally be provided with an aperture 220 having a diameter sized for a clearance fit of a spike 222 or a tent stake. A spike or tent stake may be used for affixing the leg assembly firmly to the ground to prevent the support frame and other parts of the portable painting apparatus from tipping over in windy conditions or if the apparatus is bumped or placed on uneven ground. An optional elastic cord 214 passes through the leg segments 210 to aid in aligning the leg segments with each other and holding them together. The elastic cord 214 also keeps leg segments grouped together after a leg assembly 200 is taken apart. The elastic cord 214 is anchored inside a top leg segment 210 by attachment to a first torsion spring 212 and is similarly anchored to the bottom leg segment 210 with a second torsion spring 212.

Figure 5:
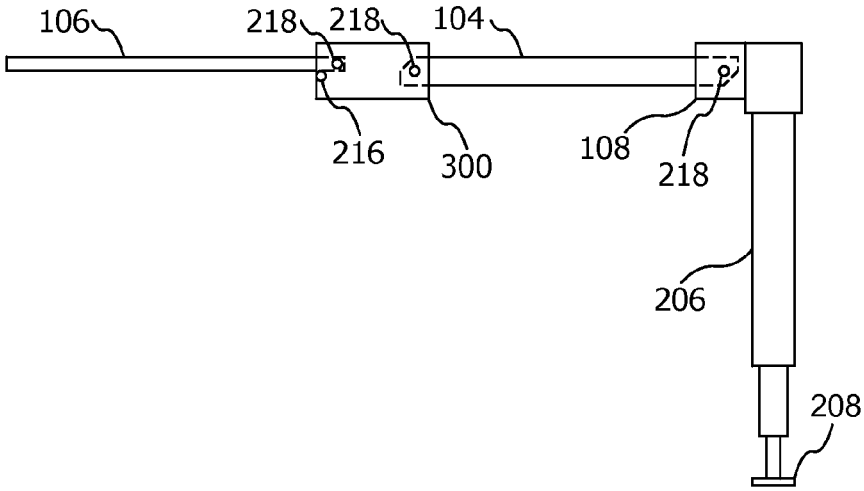
FIG. 5 is a side view of an example of a foldable leg assembly shown in an extended position.
Figure 6:
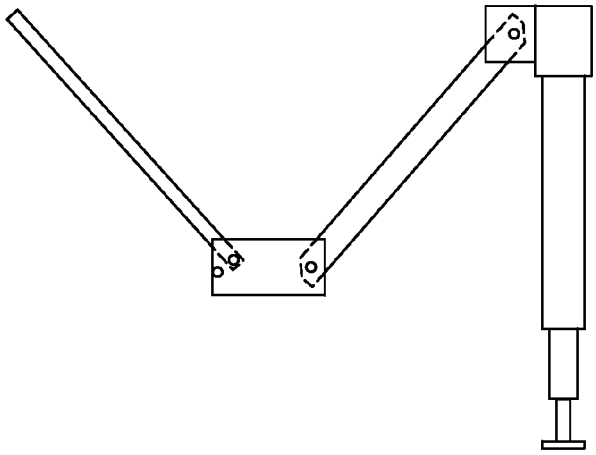
FIG. 6 is a side view of the foldable leg assembly of FIG. 5 in a partially folded position.
Figure 7:
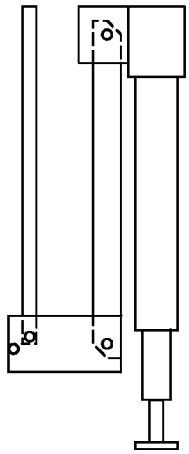
FIG. 7 is a side view of the foldable leg assembly of FIG. 5 and FIG. 6 in a folded position.

A leg assembly may optionally be provided as part of a foldable support frame, an example of which appears in FIGS. 5-7. FIGS. 5-7 illustrate folding of one leg assembly and one tent support arm, but are representative of folding support frames having at least three leg assemblies and optionally at least two tent support arms. In FIG. 5, a leg assembly comprising telescoping leg segments 206 and a foot 208 is shown with the leg segments retracted into one another. The topmost leg segment 206 attaches to a corner connector 108. An upper frame member 104 pivotally attaches to the corner connector 108 with a hinge pin 218. The upper frame member 104 is also pivotally attached to a hub assembly 300 for a support frame with another hinge pin 218. A tent support arm 106 may optionally be attached to the hub assembly with a hinge pin 218. A support pin 216 may optionally be provided for the tent support arm 106 to rest on. The folding support frame of FIG. 5 is shown partially folded in FIG. 6 and fully folded in FIG. 7.

Figure 8:
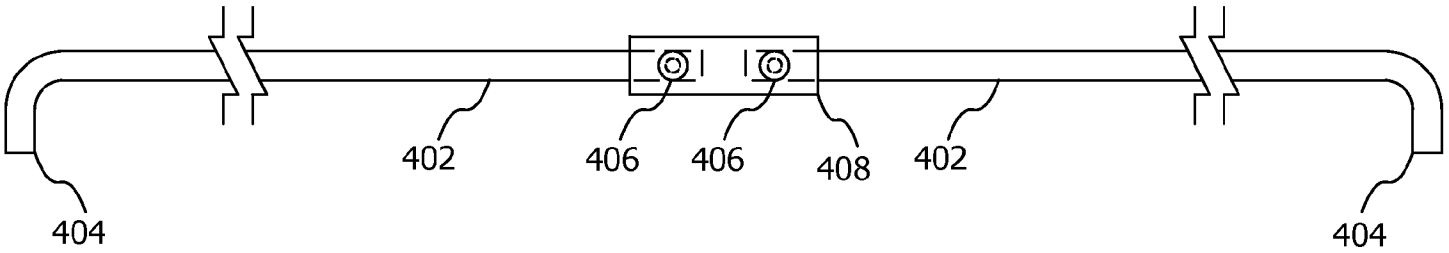
FIG. 8 is a side view of an example of a leg brace for connecting adjacent leg assemblies in a support frame.
Figure 9:
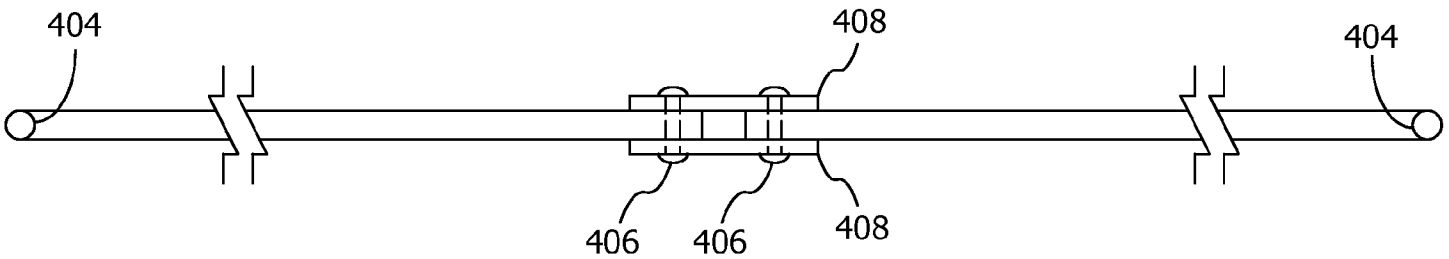
FIG. 9 is a bottom view of the leg brace of FIG. 8.

As explained in reference to FIG. 1, adjacent leg assemblies 200 in a support frame 102 may be joined with a leg brace 400 to stabilize and strengthen an assembled support frame. A leg brace 400 may alternatively be provided as a single rod with ends shaped to engage with apertures in corner connectors 108, may be separable into shorter segments that hook together, or may be foldable. An example of a foldable leg brace is shown in FIG. 8 and FIG. 9. FIG. 8 illustrates a side view of a leg brace 400 having two rods 402, each rod 402 with a rod end 404 shaped to fit into an aperture in a corner connector. The two rods 402 are pivotally joined to two hinge plates 408 with hinge pins 406. The shape of the rod ends 404, hinge plates 408, and hinge pins 406 are shown more clearly in the bottom view of a leg brace 400 in FIG. 9.

A hub assembly is a central connecting and support structure for a support frame. The hub assembly comprises a fixed part for attachment of upper frame members and a rotatable part from which an accessory hanger may be suspended. An object to be painted is attached to an accessory hanger before spraying begins and may be removed after wet paint dries sufficiently to permit handling the object directly. A hanging bracket holding the accessory hanger may be rotated about a vertical axis through the hub assembly to enable painting all sides of a suspended object without disturbing a coating of wet paint or waiting for paint to dry. An example of the fixed part of a hub assembly is shown in the pictorial view of FIG. 10. An example of a hanging bracket, the rotatable part of a hub assembly, is shown in the pictorial view of FIG. 11.

Figure 10:
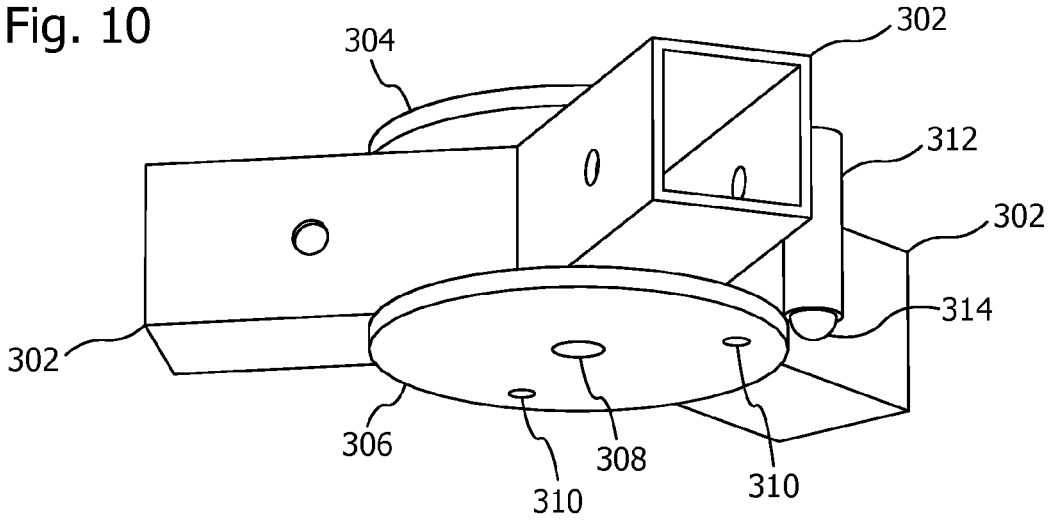
FIG. 10 is a pictorial view toward the bottom and sides of a portion of a hub assembly.

As shown in FIG. 10, at least three upper frame member receivers 302 are joined to each other, to an upper plate 304, and to a lower plate 306 to form a rigid central support structure for a support frame. There is one upper frame receiver 302 for each upper frame member in a support frame. An upper frame member receiver 302 has a size and shape selected for a sliding fit with an upper frame member. An upper frame member may optionally join to an upper frame member receiver 302 with a locking pin or threaded fastener. A hub aperture 308 passes all the way through the lower plate 306 and upper plate 304. A pair of tent support arm apertures 310 in the lower plate 306 and a corresponding pair of tent arm support apertures in the upper plate (not visible in the direction of view of FIG. 10) are provided to hold an optional pair of tent support arms. A rotation lock 312 having a spring-loaded shaft 314 with a rounded end is welded to a side of one of the upper frame member receivers 302. The spring loaded shaft 314 slides within the rotation lock 312 and engages a hole in a hanging bracket to provide an indexed rotation position for the hanging bracket.

Figure 11:
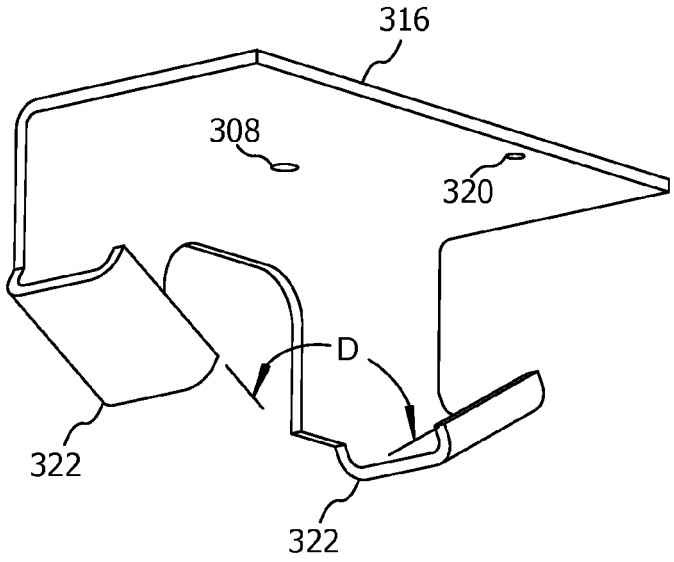
FIG. 11 is a pictorial view toward the bottom and sides of a hanging bracket for use in a hub assembly or drying rack.

FIG. 11 shows an example of the rotatable part of a hub assembly. A hanging bracket 316 may be formed from a single sheet of metal bent to shape, or may alternately be formed from separate metal pieces welded together. The hanging bracket 316 is formed with a hub aperture 308 corresponding to the hub apertures 308 in the upper plate 304 and lower plate 306 in FIG. 10. A rotation lock detent aperture 320 provides an index hole for the rounded end of the detent shaft 314 in the rotation lock 312. A hanging bracket 316 may optionally be formed with more than one rotation lock detent 320 to provide more than one indexed rotation stop position. A pair of hanger supports 322 disposed at an angle "D" to one another and positioned symmetrically on either side of a vertical plane through the center of the hub aperture 308 enable an accessory hanger suspended from the hanging bracket to be self-centering with respect to the rotation axis of the hub assembly. The hanger supports 322 are made large enough to provide an easily located engagement surface for an accessory hanger, even when the hanging bracket 316 is not visible to a person hanging an object to be painted, as may occur when hanging a large object such as a building door.

Figure 12:
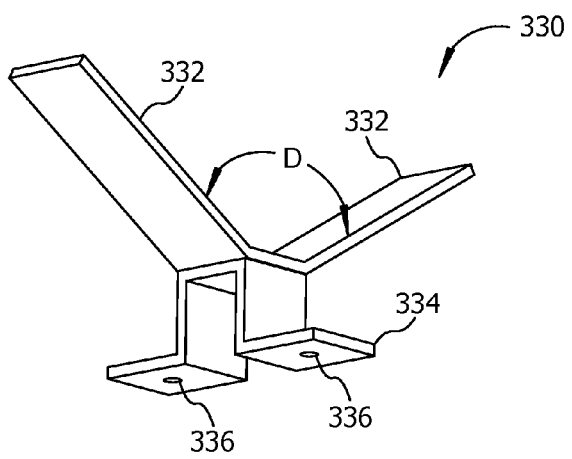
FIG. 12 is a pictorial view toward the bottom and sides of a door hanger for suspending a door from a hub assembly.

Accessory hangers are easily adapted for hanging different sizes and shapes of objects to be painted. FIG. 12 shows a pictorial view of an example of an accessory hanger for a building door. The door hanger 330 of FIG. 12 is formed with two hanger plates 332 located symmetrically about a vertical plane passing through a midline of the door hanger, thereby enabling the door hanger to be self centering when suspended from a hanging bracket. An angle "D" between the hanger plates 332 is approximately the same as the corresponding angle "D" between the hanger supports on a hanging bracket. The hanger plates 332 are attached to a hanger base 334. The hanger base 334 is formed with one or more holes 336 for attaching the door hanger 330 with threaded fasteners to a door to be painted. The door hanger 330 is preferably attached to a bottom side of a door so that an unpainted area on the door under the door hanger is not visible when the door is installed in a building. A door hanger may alternatively be attached to a top side of a door or to any other side of a door that is convenient for a particular painting project.

Figure 13:
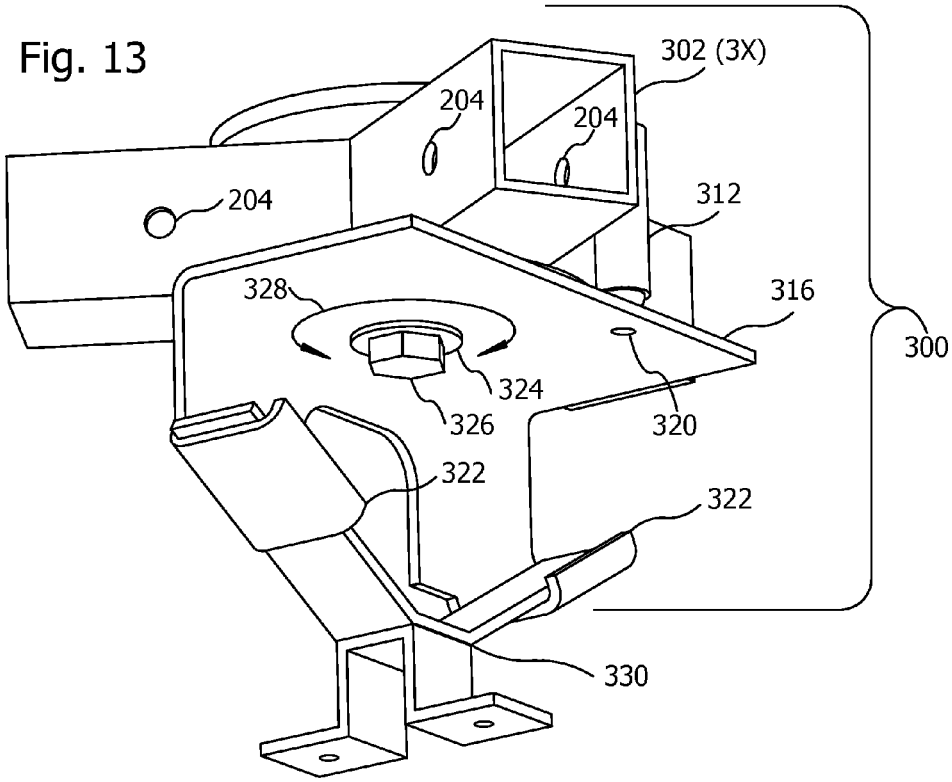
FIG. 13 is a pictorial view toward the bottom and sides of a hub assembly and a door hanger, showing the door hanger suspended from the rotatable hanging bracket.

A pictorial view of a complete hub assembly and a door hanger is shown in FIG. 13. The hub assembly 300 in FIG. 13 comprises three upper frame member receivers 302, each formed with a pair of holes 204 for locking an upper frame member to the hub assembly with a locking pin or threaded fastener. A hanging bracket 316 is rotatably joined to the fixed part of the hub assembly with a threaded fastener 326, shown in FIG. 13 as a hex head bolt, and a washer 324. Fasteners with other head styles may be used instead of the hex head bolt. A hex nut (not visible in FIG. 13) threaded onto an end of the hex head bolt 326 protruding above the upper plate holds the hub assembly 300 together. The hanging bracket 316 may be rotated about a vertical axis of rotation through the central long axis of the threaded fastener 326, in the directions indicated by a double-ended arrow 328. The rotation lock 312 engages a rotation lock detent 320 to stop rotation of the hanging bracket 316. FIG. 13 also shows a door hanger 330 suspended from the hub assembly 300 by the hanger supports 322 on the hanger bracket 316.

Figure 14:
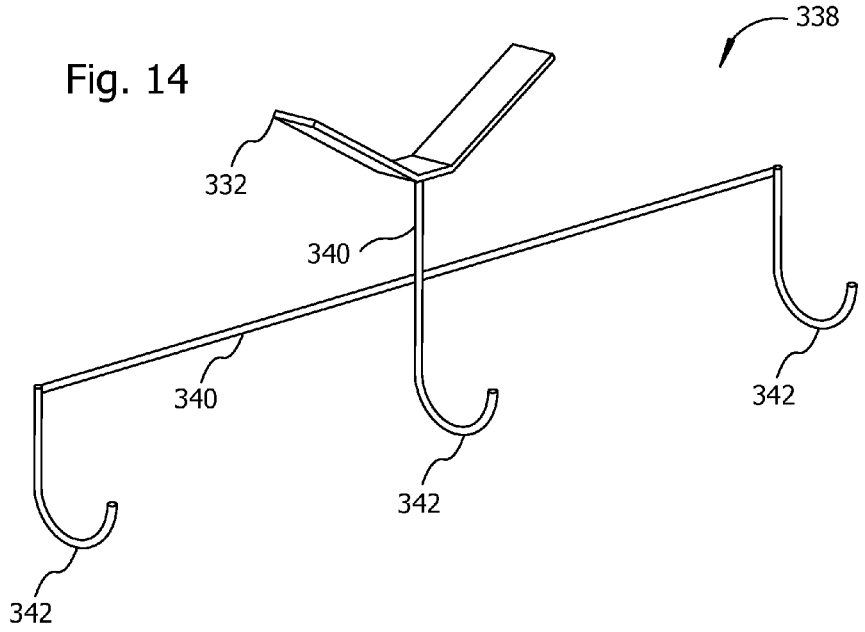
FIG. 14 is a pictorial view from above of an example of an accessory hanger comprising a plurality of support hooks for hanging objects to be painted from a hub assembly.
Figure 15:
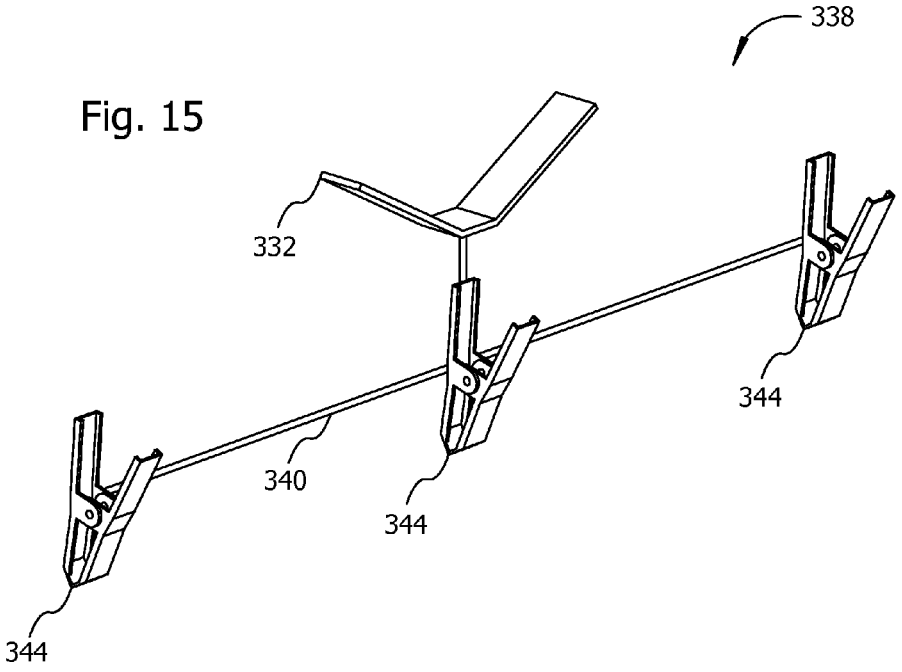
FIG. 15 is a pictorial view from above of an example of an accessory hanger comprising a plurality of spring clamps for hanging objects to be painted from a hub assembly.

FIGS. 14-15 show examples of accessory hangers which may optionally be included with an embodiment of the invention. The accessory hanger 338 of FIG. 14 comprises a plurality of hooks 342 attached to a hanger rod 340. The hanger rod 340 is attached to hanger plates 332. The accessory hanger 338 of FIG. 15 includes a plurality of spring clamps 344 attached to a hanger rod 340 which is connected to hanger plates 332. The accessory hangers 338 of FIGS. 14-15 are well suited for spray painting small or irregularly-shaped objects.

Figure 16:
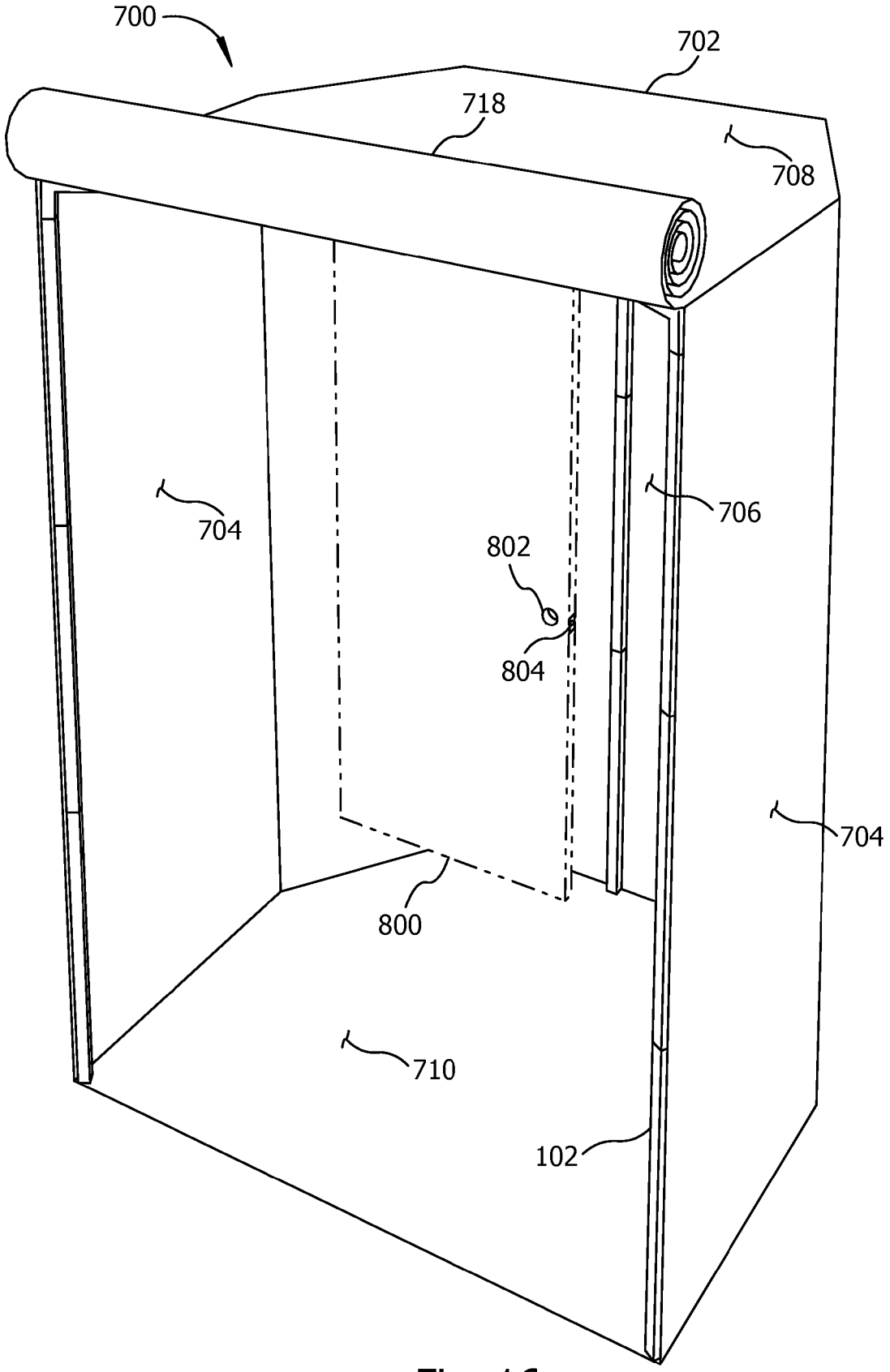
FIG. 16 is a pictorial view from above and toward the front of an example of a portable paint booth comprising a support frame and a tent, in which an optional tent door is rolled up on top of the tent and a building door drawn with phantom lines is shown suspended from the support frame inside the tent, in position for painting.

A portable paint booth includes a tent, as shown in FIG. 16. The example of a portable paint booth 700 in FIG. 16 includes a support frame 102 and a tent 702 removably attached to the support frame 102. The tent sides 704, tent back 706, tent top 708, and optional tent floor 710 provide a barrier to paint overspray and splatter and protect against dust and accidental contact with wet paint on a door 800 suspended from the support frame 102. A tent 702 may optionally include a tent door 718, shown in FIG. 16 rolled up on top of the tent top 708. The optional tent door 718 may be lowered to protect a wet painted object from dust and accidental contact while the paint dries. The tent 702 may alternatively be made from a lightweight fabric or from plastic sheeting, and may optionally be provided as a replacement item that may be removed and disposed of when it becomes torn or coated with paint.

Figure 33:
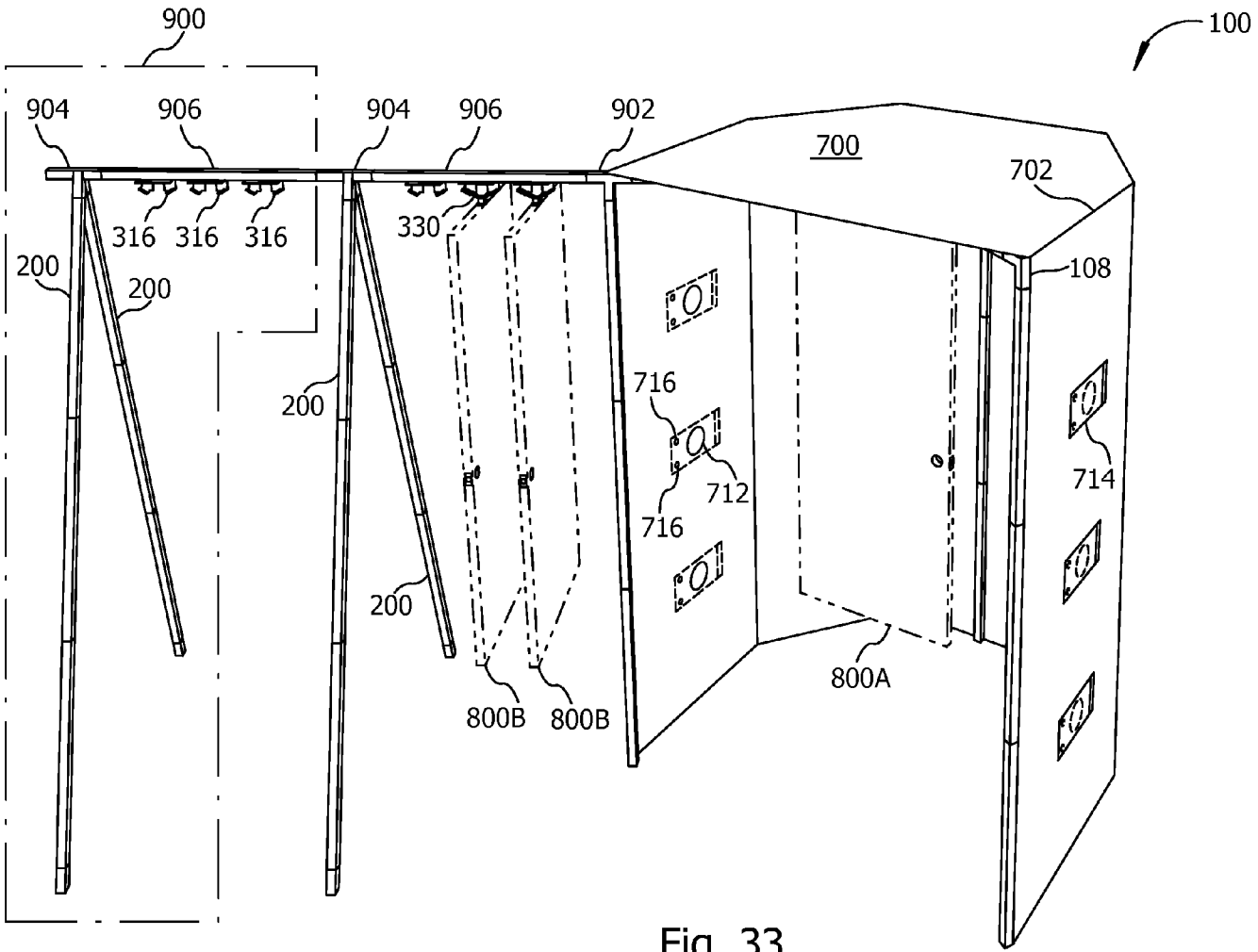
FIG. 33 is a pictorial view from above of an embodiment of the invention comprising a portable paint booth with a support frame and a tent having a plurality of exhaust ports, a first drying rack attached to the support frame, and a second drying rack attached in series with the first drying rack.

Another embodiment of a tent is shown in FIG. 33. A tent may optionally be provided with exhaust ports through which air may be withdrawn to remove solvent fumes and airborne paint from within the tent. In the example of FIG. 33, the portable paint booth 700 includes a tent 702 having a plurality of exhaust ports 712, each exhaust port 712 optionally having a diameter selected to admit a hose for a shop vacuum cleaner. An exhaust port 712 may alternatively have a size and shape for admitting ducting, tubing, or hose for other kinds of air handling or dust removal equipment. Vacuum hoses or ducting may be inserted through the exhaust ports 712 to pull air and airborne paint from within the tent with, for example, a shop vacuum or ducted fan whose exhaust may then be directed outdoors. An exhaust port 712 may optionally be fitted with a port cover 714 to close the exhaust port when it is not in use. A port cover may optionally be affixed to the tent 702 on one side of an exhaust port 712 and detachably connected with cover fasteners 716 such as snaps, hook and loop fasteners, or similar fastening means on an opposite side of the exhaust port. Alternatively, a port cover may be formed as an integral part of the tent by, for example, partially cutting a disk of material cut from the tent to form both an exhaust port and an attached port cover.

A portable painting apparatus in accord with an embodiment of the invention includes at least two removable handles for lifting and carrying a wet painted door. FIGS. 17-27 show details for alternative embodiments of removable handles. Some removable handles are adapted to fit into a latch aperture on a door. An example of a latch aperture 804 on a side of a door 800 is shown near a doorknob aperture 802 in FIG. 16. An example of a removable handle comprising a latch handle 600 is shown in FIG. 1 inserted into a latch aperture on a side of the door 800. Other removable handles are adapted to fit into a hinge area on a door. An example of a removable handle comprising a hinge handle 500 is shown installed on a door 800 in three places 500A, 500B, and 500C in FIG. 1. Preferably one latch handle 600 and one hinge handle 500 are used simultaneously to lift a wet painted door, although one may use a different number of removable handles at one's discretion. Some handles (500, 600) are preferably removed from a door while the door is being painted, while parts of other handles may optionally be left in place during painting, as will be explained below.

Figure 17:
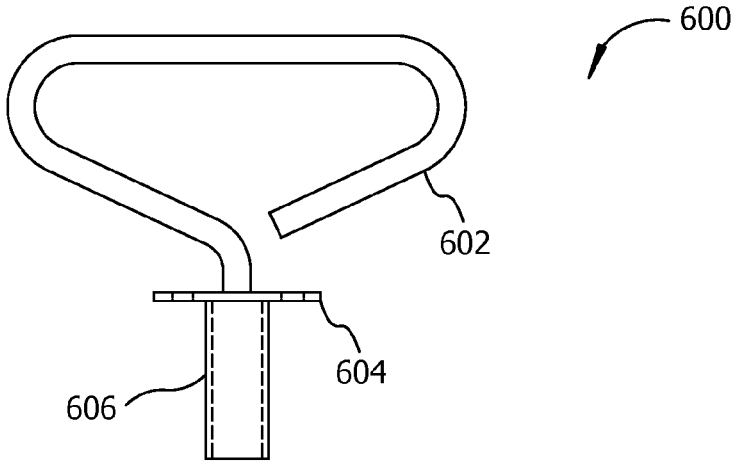
FIG. 17 is a side view of an example of a latch handle for use in an embodiment of the invention.
Figure 18:
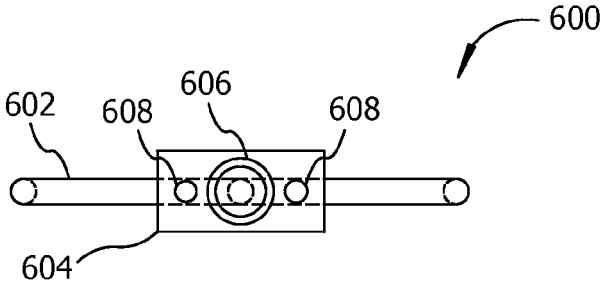
FIG. 18 is an end view of the latch handle of FIG. 17.

FIG. 17 shows a side view of a latch handle 600 adapted for slidably engaging with a latch aperture in a door. The latch handle 600 includes a hand grip 602 attached to a stop plate 604. A lockset plug 606 attached to the stop plate 604 is sized for a close sliding fit into a lockset hole in a door. The latch handle 600 of FIG. 17 is shown in a bottom view in FIG. 18. The lockset plug 606 may optionally be formed as a hollow cylinder as shown in FIG. 18, or may alternately be a solid plug. The stop plate 604 may optionally be formed with clearance holes 608 for threaded fasteners to attach the latch handle 600 to a door, although generally threaded fasteners are not required to safely and securely carry a door using the latch handle. Clearance holes in a stop plate may optionally be formed as slots to accommodate variations in the positions of holes in different doors.

Figure 19:
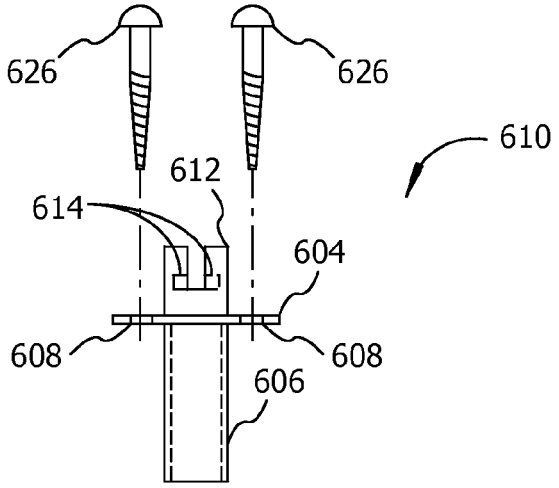
FIG. 19 is a side view of an example of a twist lock latch receiver for use with a twist lock hand grip, for example a twist lock hand grip as shown in FIG. 20.
Figure 20:
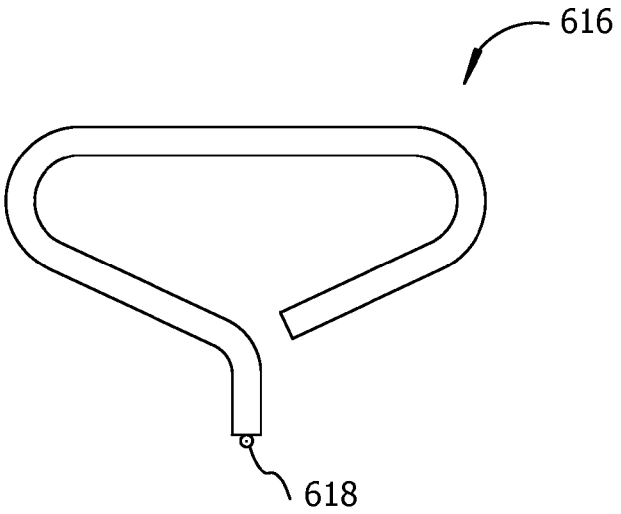
FIG. 20 is a side view of an example of a twist lock hand grip for use with a twist lock latch receiver as in FIG. 19 or FIGS. 22-25, or with a twist lock hinge receiver as in FIG. 26 or FIG. 27.

A lockset plug may optionally be detachable from a latch handle. FIG. 19 shows a side view of an example of a twist lock latch receiver 610 comprising a lockset plug 606 and a twist lock hand grip connector 612 attached to a stop plate 604. The stop plate 604 is formed with at least two through-holes 608 sized for a clearance fit of threaded fasteners 626. Threaded fasteners 606 may optionally be used with any of the handles having stop plates with clearance holes, for example the stop plates in FIGS. 17, 18, 22, 23, and alternative versions of FIGS. 24-27 in which through holes replace pointed posts 622. The twist lock hand grip connector includes two "L"-shaped twist lock slots 614 on opposite sides of the twist lock hand grip connector 612. The twist lock slots 614 are engaged by a transverse pin on a twist lock hand grip. FIG. 20 shows a side view of a twist lock hand grip 616 with a transverse pin 618. FIG. 231 shows a bottom view of the twist lock hand grip 616 and transverse pin 618 of FIG. 20. The twist lock hand grip 616 engages with the twist lock latch receiver 610 by inserting the transverse pin 618 on the hand grip into the "L"-shaped slots 614 on the twist lock hand grip connector 612 and turning the hand grip approximately one-quarter turn. Whereas a latch handle 600 is preferably removed from a door before spray painting begins, a twist lock latch receiver 610 may optionally be left in place on the door and only the twist lock hand grip 616 removed during painting.

Figure 21:
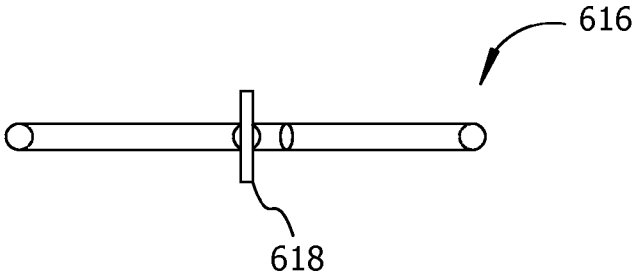
FIG. 21 is a view toward a transverse pin on an end of the twist lock hand grip of FIG. 20.
Figure 22:
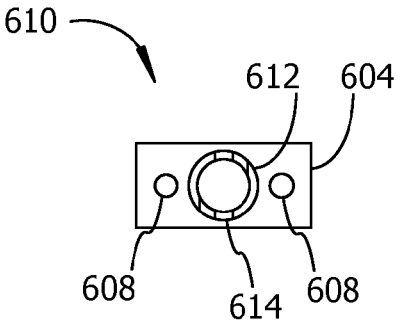
FIG. 22 is a top view of an example of a twist lock latch receiver for attachment with threaded fasteners to the latch area on an edge of a door.
Figure 23:
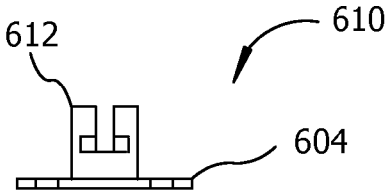
FIG. 23 is a side view of the twist lock latch receiver of FIG. 22.

A twist lock latch receiver may optionally be made without a lockset plug. An example of a twist lock latch receiver adapted for attachment to a door with threaded fasteners is shown in a top view in FIG. 22 and a side view in FIG. 23. The twist lock latch receiver 610 of FIGS. 22-23 comprises a twist lock hand grip connector 612 having "L"-shaped twist lock slots 614 adapted to receive a twist lock hand grip 616 as shown in FIGS. 20-21. The twist lock latch receiver 610 of FIGS. 22-23 further includes a stop plate 604 formed with at least two apertures 608 for threaded fasteners used to attach the twist lock latch receiver 610 to a door. By changing a number and location of holes 608 in a stop plate 604, the twist lock latch receiver 610 may be adapted to fit a hinge area on a door.

Figure 24:
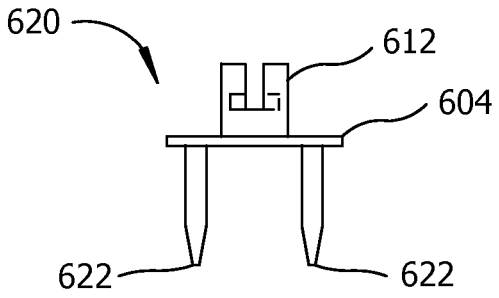
FIG. 24 is a side view of another embodiment of a twist lock latch receiver having pointed posts for engaging holes in a latch area on a side of a door.
Figure 25:
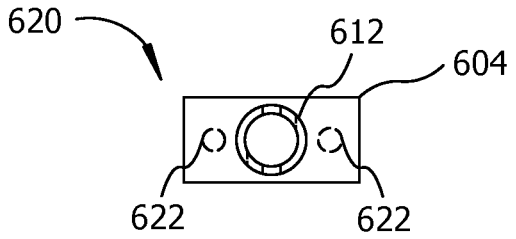
FIG. 25 is a top view of the twist lock latch receiver of FIG. 24.

A twist lock latch receiver may optionally include pointed posts having a diameter and length selected for a close sliding fit in holes in the side of a door. The pointed posts eliminate a need for threaded fasteners to attach a removable handle to the door. FIGS. 24-25 show an example of a twist lock latch receiver 620 having two pointed posts 622 for slidably engaging with threaded holes near a latch aperture in a door. The twist lock receiver 620 of FIGS. 24-25 also includes a twist lock hand grip connector 612 and a stop plate 604.

Figure 26:
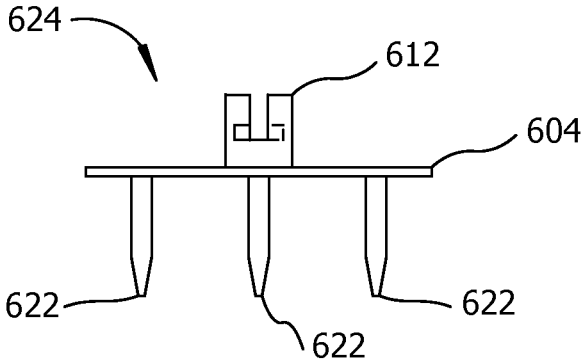
FIG. 26 is a side view of a twist lock hinge receiver having pointed posts for engaging holes in a hinge area on a side of a door.
Figure 27:
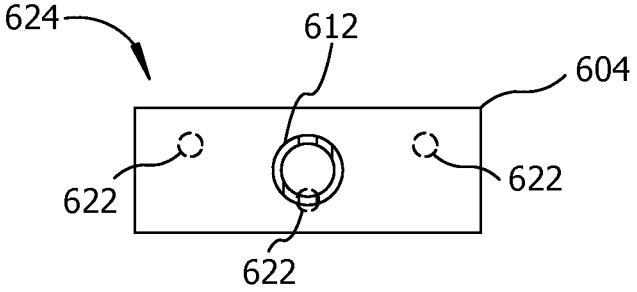
FIG. 27 is a top view of the twist lock hinge receiver of FIG. 26.

A twist lock hinge receiver may similarly be fitted with pointed posts for slidably engaging threaded holes in the hinge area of a door. FIG. 26 shows a side view of a twist lock hinge receiver 624 having a twist lock hand grip connector 612 and three pointed posts 622 attached to opposite sides of a stop plate 604. FIG. 27 shows a view toward the bottom of the twist lock hinge receiver 624 of FIG. 26. FIG. 27 further shows that the pointed posts 622 are attached to the stop plate 604 in a pattern that matches the pattern of holes in the hinge area of a door. In alternative embodiments, the pointed posts in FIGS. 24-27 are attached in different patterns to the stop plates to engage hole patterns in the latch and hinge areas of different doors.

An embodiment of a portable painting apparatus may optionally include an expandable drying rack. The drying rack may optionally be attached to a support frame to provide a convenient location for drying close to a portable painting booth. Additional drying racks may be attached in serial fashion to provide any desired capacity for hanging wet painted objects while paint dries. Two or more drying racks may optionally be connected to each other to form a free-standing drying rack that is not connected to a support frame. A drying rack includes a plurality of hanging brackets adapted to receive accessory hangers for a portable paint booth.

Figure 29:
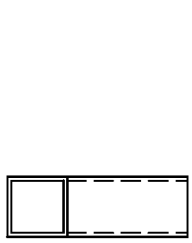
FIG. 29 is an end view of the top bar connector of FIG. 28.
Figure 28:
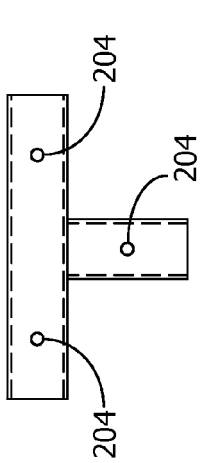
FIG. 28 is a side view of an example of a top bar connector for a drying rack.

A portable painting apparatus may be adapted for connection of a drying rack by replacing one of the corner connectors, for example one of the corner connectors 108 shown in FIG. 1, with a top bar connector. A top bar connector 902 for a drying rack is shown in the side view of FIG. 28 and end view of FIG. 29. A top bar connector 902 includes a plurality of locking pin apertures 204 for accepting locking pins or threaded fasteners used assemble the drying rack.

Figure 31:
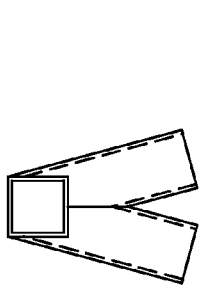
FIG. 31 is an end view of the example of a leg connector of FIG. 30.
Figure 30:
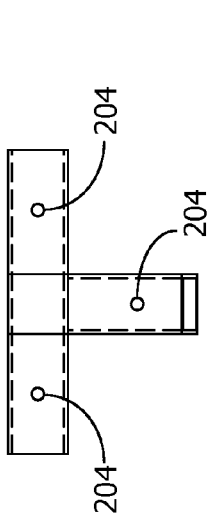
FIG. 30 is a side view of an example of a leg connector for a drying rack.
Figure 32:
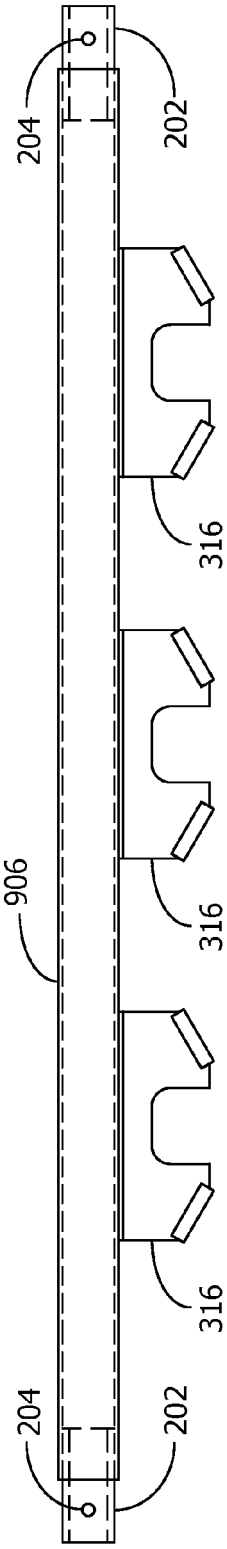
FIG. 32 is a side view of an example of a top bar for a drying rack.

A drying rack further includes two leg assemblies joined by a leg connector. A leg connector 904 is shown in a side view in FIG. 30 and an end view in FIG. 31. A leg connector 904 includes a plurality of locking pin apertures 204 for accepting locking pins or threaded fasteners used assemble the drying rack. Any of the leg assemblies described herein for use with a support frame may optionally be used with a drying rack. A leg assembly for a drying rack may optionally include a different number of leg segments than a leg assembly for a support frame. The leg assemblies are joined to the leg connector 904 at an acute angle relative to one another. The combination of the leg assemblies and leg connector are connected to a support frame, or alternatively to another drying rack, by a top bar. A top bar, shown in a side view in FIG. 32, includes a plurality of hanging brackets 316 attached to a bottom side of the top bar 906. The top bar 906 includes two connector inserts 202, one at each end of the top bar, for connecting the top bar to a leg connector 904 and a top bar connector 902.

FIG. 33 shows an example of a portable painting apparatus 100 including more than one drying rack connected in series to a portable paint booth 700. In FIG. 33, a top bar connector 902 has replaced a corner connector 108 in the support frame for the portable paint booth 700. A first drying rack comprising a top bar 906 carrying a plurality of hanging brackets 316 is connected between the top bar connector 902 and a leg connector 904. Two leg assemblies 200 are also connected to the leg connector 904. A second drying rack 900, indicated by a border line, is attached in series to the first drying rack. A selected number of drying racks may be connected in series to give a desired capacity for hanging objects while wet paint dries. Two wet painted doors 800B are shown hanging by door hangers 330 from hanging brackets 316 in FIG. 33. Another door 800A is shown hanging within the tent 702, ready for spray painting.

Hollow tubing may optionally be used to form leg assemblies, parts of the hub assembly, corner connectors, upper frame members, parts of a drying rack, and other parts of a portable painting apparatus. Any of the hollow parts described in the preceding examples may optionally be formed with a circular cross section, square cross section, or other polygonal cross sectional shape.

A portable paint booth includes a tent as previously described. A tent may alternatively be formed with a polygonal tent top, a circular tent top, or a tent top shaped as a circular segment. An optional tent floor may alternatively have a same size and shape as a tent top or may have a different size or a different shape than the tent top.

Although previous examples have included spray painting as a means for applying paint to an object, it will be appreciated that embodiments of the invention are advantageous for applying paint by other means. For example, a support frame, drying rack, and removable handles could be used indoors without a tent for painting doors or other objects with a brush or roller. Or, the portable painting apparatus including the tent could be used indoors to provide a barrier to paint splatter and drips from a brush or roller. The entire apparatus including a tent could be used to paint objects with a brush or roller outdoors, taking advantage of the wind shelter and protection from dust and accidental contact with wet paint provided by the tent.

Unless expressly stated otherwise herein, ordinary terms have their corresponding ordinary meanings within the respective contexts of their presentations, and ordinary terms of art have their corresponding regular meanings

What is claimed is:

1. An apparatus, comprising:

a portable paint booth, comprising:

a support frame comprising:

a hub assembly for rotatably suspending an object to be painted, comprising:

an upper plate;

three upper frame member receivers joined to said upper plate;

a lower plate having a top surface joined to said three upper frame member receivers and a bottom surface; and a hanging bracket rotatably coupled to said bottom surface of said lower plate, said hanging bracket comprising two hanger supports disposed at an obtuse angle to one another;

three upper frame members, each of said upper frame members comprising a first end which slidably engages with a separate one of said three upper frame member receivers in said hub assembly and a second end opposite said first end;

three corner connectors, each of said corner connectors slidably engaging with a separate one of said second end of said at least three upper frame members;

three leg assemblies, each of said leg assemblies slidably engaging with a separate one of said at least three corner connectors;

an accessory hanger comprising two hanger plates disposed at said obtuse angle to one another, and said accessory hanger removably suspended from said hanging bracket by said two hanger plates in contact with said two hanger supports; and a tent for blocking paint overspray, said tent supported by said support frame.

2. The apparatus of claim 1, wherein said tent further comprises at least one exhaust port for withdrawing airborne paint from within said portable paint booth.

3. The apparatus of claim 1, wherein said support frame further comprises at least two tent support arms for holding said tent away from the object being painted and each of said tent support arms is adapted for attachment to said hub assembly.

4. The apparatus of claim 1, wherein said hanging bracket is adapted for self-centering suspension of the object to be painted.

5. The apparatus of claim 1, wherein said accessary hanger comprises a hanger base joined to said two hanger plates, and said hanger base is adapted for removable attachment to a building door.

6. The apparatus of claim 1, wherein said accessory hanger comprises:

a hanger rod;

said two hanger plates joined to said hanger rod; and a plurality of spring clamps joined to said hanger rod.

7. The apparatus of claim 1, wherein said accessory hanger comprises:

a hanger rod;

said two hanger plates joined to said hanger rod; and a plurality of hooks joined to said hanger rod.

8. The apparatus of claim 1, further comprising a drying rack adapted for attachment to said portable paint booth.

9. The apparatus of claim 8, wherein said drying rack further comprises:

a top bar connector adapted for attachment to said support frame;

a top bar adapted for attachment to said top bar connector;

two leg assemblies; and a leg connector adapted for attachment to said top bar and to both of said leg assemblies.

10. The apparatus of claim 9, wherein said top bar further comprises a plurality of hanging brackets attached to said top bar and each of said plurality of hanging brackets is adapted for self-centering suspension of the object to be painted.

11. The apparatus of claim 10, further comprising a plurality of said drying rack connected to each other in series.

12. The apparatus of claim 11, wherein said plurality of drying racks connected to each other in series are connected by attaching a top bar from a selected drying rack to a leg connector for another drying rack.

13. The apparatus of claim 1, further comprising a first removable handle for lifting the object to be painted, said removable handle comprising:

a stop plate;

a lockset plug joined to said stop plate, wherein said lockset plug is adapted for a sliding fit into a latch aperture on a building door; and a hand grip attached to said stop plate.

14. The apparatus of claim 1, further comprising: a first removable handle for lifting the object to be painted, said removable handle comprising:

a stop plate;

a twist lock hand grip connector joined to said stop plate;

a twist lock hand grip comprising an open loop and a transverse pin attached to a shaft extending from said open loop;

wherein said transverse pin selectively engages or disengages with a slot formed in said twist lock hand grip connector.

15. The apparatus of claim 1, further comprising a first removable handle for lifting the object to be painted, said removable handle comprises:

a stop plate;

a twist lock hand grip connector joined to said stop plate;

at least two pointed rods attached to said stop plate, wherein each of said pointed rods are adapted for a sliding fit into threaded apertures for a lockset in a building door; and a hand grip adapted for selective engagement or disengagement with said twist lock hand grip connector.

16. The apparatus of claim 1, wherein said tent is provided as a disposable replacement item.

17. The apparatus of claim 1, wherein said hub assembly and said leg assemblies are hinged together to form a foldable support frame.

18. An apparatus, comprising:

a portable paint booth, comprising:

a support frame comprising:

a hub assembly for rotatably suspending an object to be painted;

at least three upper frame members, wherein each of said upper frame members is adapted for attachment to said hub assembly;

at least three corner connectors, wherein each of said corner connectors is adapted for attachment to an upper frame member; and at least three leg assemblies, wherein each of said leg assemblies is adapted for attachment to a corner connector;

a tent for blocking paint overspray, wherein said tent is supported by said support frame;

a first removable handle for lifting a wet-painted building door, comprising:

a stop plate;

a twist lock hand grip connector joined to said stop plate;

a twist lock hand grip comprising an open loop and a transverse pin attached to a shaft extending from said open loop;

a lockset plug joined to said stop plate, wherein said lockset plug is adapted for a sliding fit into a latch aperture on a building door; and a second removable handle for lifting a wet-painted building door, wherein said first and second removable handles are adapted for carrying a wet-painted building door from said portable paint booth without disturbing a coating of wet paint on the door and said transverse pin selectively engages or disengages with a slot formed in said twist lock hand grip connector.

* * * * *